US005511985A

United States Patent [19]

Noschese et al.

[11] Patent Number: 5,511,985

[45] Date of Patent: Apr. 30, 1996

[54] ANGLED CARD EDGE CONNECTOR

[75] Inventors: Rocco J. Noschese, Wilton; Heinz Piorunneck, Trumbull, both of Conn.; Fernando J. Ramirez, Fountain Valley, Calif.

[73] Assignee: Burndy Corporation, Norwalk, Conn.

[21] Appl. No.: 260,881

[22] Filed: Jun. 16, 1994

[51] Int. Cl.[6] ..... H01R 13/62

[52] U.S. Cl. ..... 439/157; 439/637; 439/377

[58] Field of Search ..... 439/326–328, 439/630–637, 733, 751, 152–160, 377, 374

[56] References Cited

U.S. PATENT DOCUMENTS

| | | | |
|---|---|---|---|
| 3,767,974 | 10/1973 | Donovan, Jr. et al. | 317/101 DH |
| 4,070,081 | 1/1978 | Takahashi | 339/91 R |
| 4,178,051 | 12/1979 | Kocher et al. | 339/45 M |
| 4,241,966 | 12/1980 | Gomez | 339/45 M |
| 4,445,740 | 5/1984 | Wallace | 339/45 M |
| 4,473,263 | 9/1984 | Sunstein | 339/17 LM |
| 4,579,408 | 4/1986 | Sasaki | 339/45 M |
| 4,756,694 | 7/1988 | Billman et al. | 439/61 |
| 4,862,400 | 8/1989 | Selbrede | 364/708 |
| 4,898,540 | 2/1990 | Saito | 439/153 |
| 4,973,255 | 11/1990 | Rudoy | 439/157 |
| 4,975,073 | 12/1990 | Weisman | 439/157 |
| 5,061,201 | 10/1991 | Utan | 439/326 |
| 5,074,800 | 12/1991 | Sasao et al. | 439/157 |
| 5,100,337 | 3/1992 | Chao | 439/326 |
| 5,162,002 | 11/1992 | Regnier | 439/157 |
| 5,167,517 | 12/1992 | Long | 439/160 |
| 5,174,780 | 12/1992 | Lee | 439/326 |
| 5,199,907 | 4/1993 | Jansen et al. | 439/751 |
| 5,259,768 | 11/1993 | Brunker et al. | 439/751 |
| 5,364,282 | 11/1994 | Tondreault | 439/157 |
| 5,387,133 | 2/1995 | Tondreault et al. | 439/751 |
| 5,389,000 | 2/1995 | DiViesti et al. | 439/157 |

OTHER PUBLICATIONS

AMP Incorporated Catalog 82834, "Dual Read-Out SIMM Sockets", Feb. 1993, 4 pages.

Electronic Industries Association, "Detail Specification For Multi-Package Module Sockets 50 Mil Pitch", Vertical Mounting Dual Read Out For use in Electronic Equipment, Jul. 15, 1993, pp. 1–30.

*Primary Examiner*—David L. Pirlot

*Attorney, Agent, or Firm*—Perman & Green

[57] ABSTRACT

A card edge connector comprising a housing, electrical contacts, and ejectors. The housing has a middle section with a card edge receiving area, two guide projections at opposite ends of the middle section, and a keeper section. The electrical contacts extend from the middle section, through the keeper, to a bottom of the housing. The housing is suitably configured to receive a daughter printed circuit board at an angle of about 30° relative to a mother printed circuit board. The ejectors are adapted to lock the daughter board to the connector and, eject the daughter board from the connector.

25 Claims, 6 Drawing Sheets

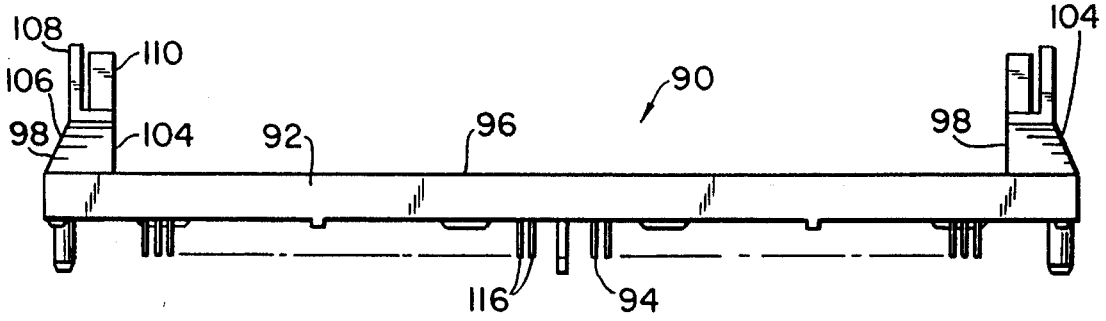
FIG. 4A
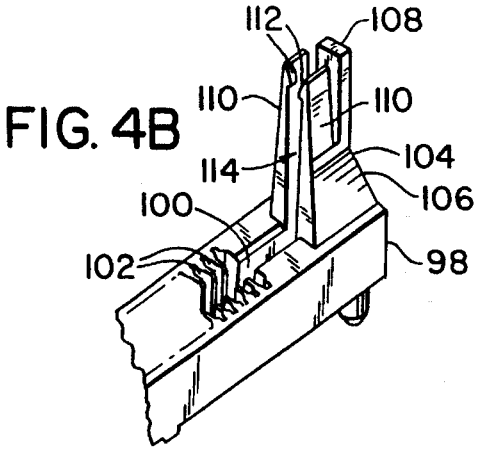
FIG. 4B
FIG. 4C
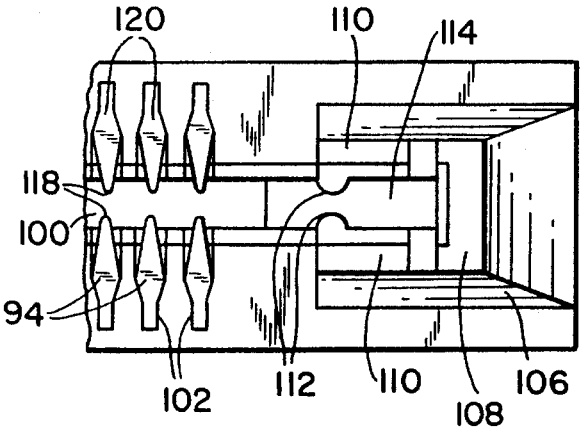
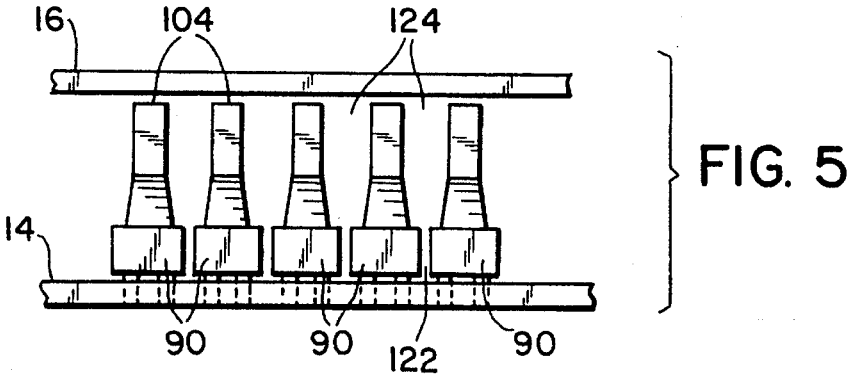
FIG. 5

ANGLED CARD EDGE CONNECTOR

BACKGROUND OF THE INVENTION

1. Field of the Invention

The present invention relates to electrical connectors and, more particularly, to an angled card edge connector.

2. Prior Art

U.S. Pat. No. 4,756,694 discloses a dual row connector for receiving memory modules for a low profile package. The connector can receive the memory modules at an angle of 25° . U.S. Pat. Nos. 4,473,263 and 4,862,400 also relate to angled connection of daughter boards to a mother board. U.S. Pat. No. 4,241,966 discloses an electrical connector with an ejector-retainer. Other relevant U.S. Pat. Nos. that disclose ejectors include 5,167,517; 4,898,540; 5,074,800; 4,070,081; 4,579,408; 3,767,974; 4,973,255; 4,975,073.

SUMMARY OF THE INVENTION

In accordance with one embodiment of the present invention a card edge connector is provided comprising a housing and electrical contacts. The housing has a first member and a second member. The first member comprises a middle section with a card edge receiving area and two rows of contact receiving channels, one at each side of the receiving area. The first member also comprises two guiding projections located at opposite ends of the middle section. The second member comprises a keeper section with at least four rows of contact passages. The housing is suitably sized and shaped to be connected to a mother printed circuit board and have a daughter printed circuit board connected to the housing in the card edge receiving area at an angle of between about 20° and 60° relative to a plane of the mother printed circuit board. The electrical contacts are located in the contact receiving channels and extend through the contact passages of the keeper section.

In accordance with another embodiment of the present invention a card edge connector is provided comprising a housing, electrical contacts, and ejectors. The housing has a middle section and two guiding projections located at opposite ends of the middles section. The middle section has a card edge receiving area and two rows of contact receiving channels on opposite sides of the receiving area. The housing is suitably sized and shaped to be connected to a mother printed circuit board and have a daughter printed circuit board connected to the housing in the card edge receiving area at an angle of between about 20° and 60° relative to a plane of the mother printed circuit board. The electrical contacts are located in the contact receiving channels and extend from a bottom of the housing. The ejectors are pivotably connected to the housing at the guide projections and are adapted to eject, at least partially, a daughter printed circuit board from the card edge receiving area.

BRIEF DESCRIPTION OF THE DRAWINGS

The foregoing aspects and other features of the invention are explained in the following description, taken in connection with the accompanying drawings, wherein:

FIG. 4A is an elevational side view of an alternate embodiment of the present invention;

FIG. 4B is a perspective view of one end of the connector shown in FIG. 4A;

FIG. 4C is an enlarged plan top view of the end of the connector shown in FIG. 4B;

FIG. 5 is a partial schematic elevational side view of a plurality of the connector shown in FIGS. 4A–4C mounted in an electronic component;

DETAILED DESCRIPTION OF THE INVENTION

Figure 1:
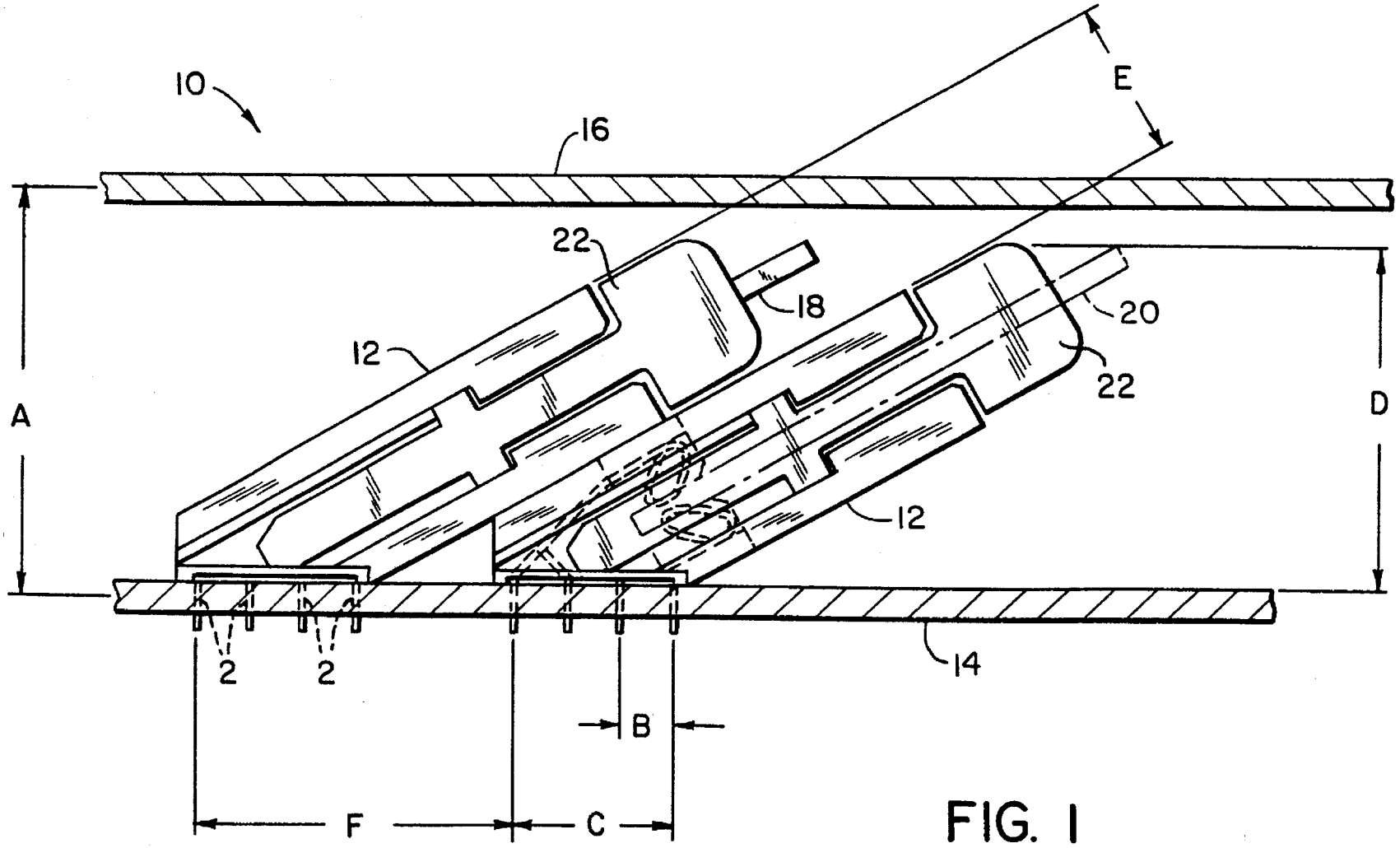
FIG. 1 is a schematic sectional view of an electronic component having electrical connectors incorporating features of the present invention.

Referring to FIG. 1, there is shown a partial schematic sectional view of an electronic component 10 having electrical connectors 12 incorporating features of the present invention. Although the present invention will be described with reference to the embodiments shown in the drawings, it should be understood that the present invention can be embodied in various different forms of alternate embodiments. In addition, any suitable size, shape, or type of elements or materials could be used.

In the embodiment shown, the electronic component 10 includes two parallel mother printed circuit boards 14, 16, two daughter printed circuit boards 18, 20, and two of the electrical connectors 12. The two connectors 12 are connected to the first mother printed circuit board 14 and, connect the two daughter printed circuit boards 18, 20 to the first mother printed circuit board 14. In an alternate embodiment, the electronic component 10 could have only one mother printed circuit board or more than two mother printed circuit boards. In addition, any suitable number of the connectors 12 could be provided including one or more than two and, could be connected to both of the mother printed circuit boards 14, 16. The electronic component 10 could be any suitable type of electronic component, such as a computer. The daughter boards 18, 20 are removably connected to the connectors 12. Therefore, the electronic component 10 can be sold without the daughter boards 18, 20 and the purchaser has the option to add the daughter boards to the component at a later date. In a preferred embodiment, the daughter boards 18, 20 are double sided SIMM printed circuit boards or memory boards. However, any suitable type of daughter boards could be used.

Figure 2:
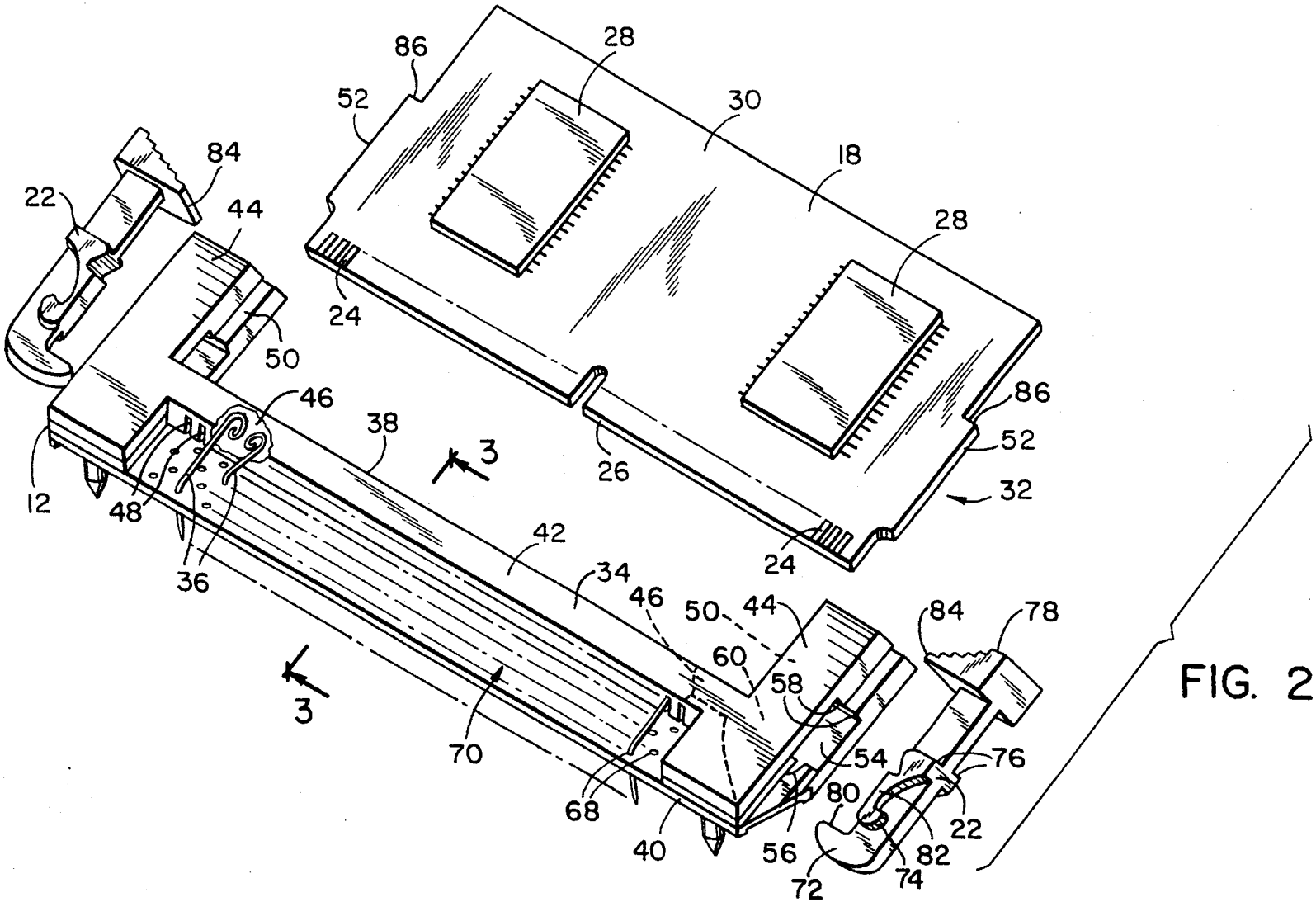
FIG. 2 is an exploded perspective view of one of the connectors shown in FIG. 1 and the daughter printed circuit board that is connected to that connector.

Referring also to FIG. 2, one of the connectors 12 is shown in a partially exploded view with the first daughter board 18 and ejectors 22. The daughter board 18 has contact pads 24 at a card edge 26 and electronics 28 on both the top side 30 and bottom side 32 of the board 18.

Figure 3:
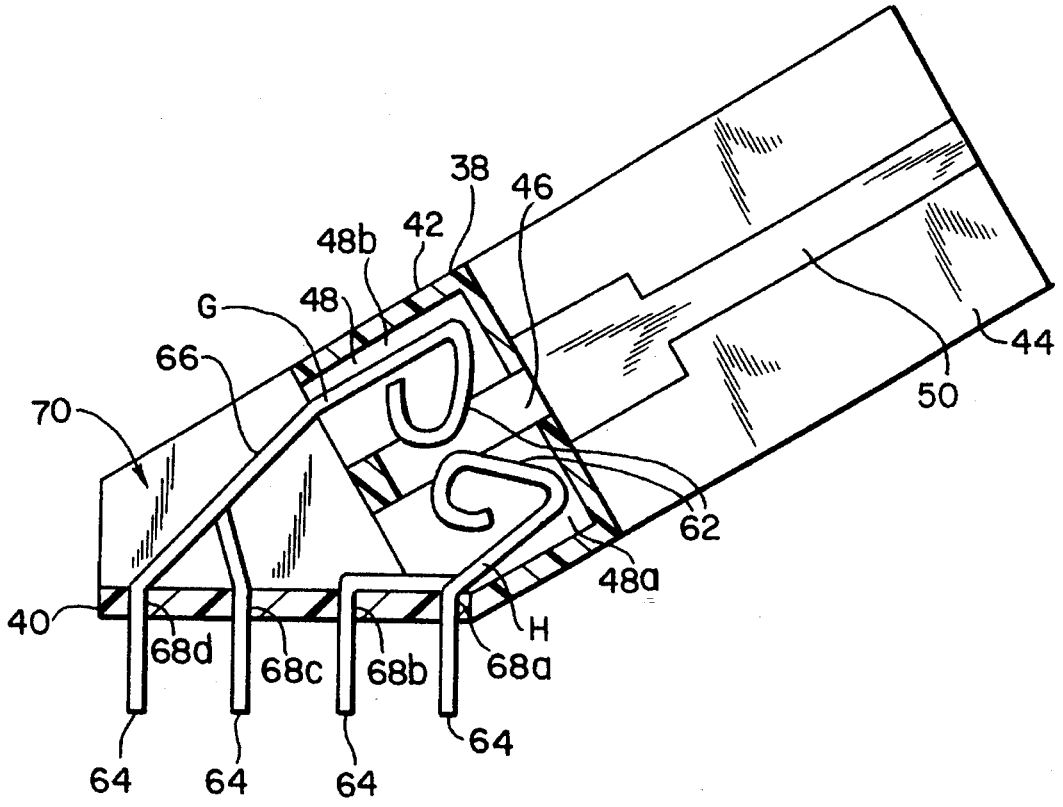
FIG. 3 is a cross sectional view of the connector shown in FIG. 2 taken along line 3—3.

The connector 12 is generally comprised of a housing 34, electrical contacts 36, and the two ejectors 22. The housing 34 is comprised of a first member 38 and a second member 40 that are connected to each other. In alternate embodiments one member or more than two members could be used to form the housing 34. The two members 38, 40 are both made of dielectric material, such as molded plastic or polymer material. The first member 38 has a middle section 42 and two guide projections 44 extending out in front of the middle section from opposite ends. Referring also to FIG. 3, the middle section 42 includes a card edge receiving area or slot 46 and two rows of contact receiving channels 48 located on opposite sides of the receiving area 46. The channels 48 intersect with the receiving area 46 and have apertures at the rear of the middle section 42. The receiving area 46 is suitably sized and shaped to receive the card edge 26 therein. The guide projections 44 have interior facing slots 50 for slidingly receiving end edges 52 of the daughter board 18. The guide projections 44 also have exterior facing slots 54. The ejectors 22 are pivotably mounted to the guide projections 44 in the exterior facing slots 54. The exterior facing slots 54 have snap-lock pivot sections 56, ledges 58, and a passage 60 from the exterior facing slots 54 to the card edge receiving area 46.

The second member or keeper 40 is fixedly connected to the bottom of the first member 38. The second member 40 is a substantially flat member with contact passages or holes 68. The holes 68 are arranged into four rows that are staggered relative to holes in adjacent rows. The first and second rows 86*a*, 86*b* receive portions of the contacts 36 from the bottom receiving channels 48*a*. The third and fourth rows 68*c*, 68*d* receive portions of the contacts 36 from the top receiving channels 48*b*. An open area 70 is established at the rear of the middle section 42. This open area 70 is used to allow transition of the different shaped contact middle sections 66 from the receiving channels 48 to the holes 68. The second member 40 functions as a keeper to keep the tail ends 64 of the contacts 36 in a predetermined pattern for easy connection to holes 2 in the mother board 14.

The electrical contacts 36 are comprised of electrically conductive material. Each contact 36 includes a spring contact section 62, a solder tail 64 and a middle section 66 between the spring contact section 62 and solder tail 64. The spring contact sections 62 are arranged in two rows in the contact receiving channels 48. The middle sections 66 extend from the contact receiving channels 48 to the holes 68 in the second member 40. The middle sections 66 are fixedly connected to the first member 38 at areas G and H in the receiving channels 48. However, the spring contact sections 62 are still able to deflect when the card edge 26 is inserted into the receiving slot 46.

The ejectors 22 are provided to assist in ejecting the daughter board 18 from the connector 12. In addition, the ejectors 22 also function as a locking latch to hold the daughter board 18 in a locked position in the connector 12 until the ejectors 22 are moved. In an alternate embodiment, the ejectors 22 need not be provided. Alternatively, other shapes or types of ejectors could be used. Each ejector 22 generally comprises a bottom ejector foot 72, two snap-lock pivot sections 74, one on each side of the ejector, two seating ledges 76, also one on each side of the ejector, and a finger contact section 78 at the top of the ejector. The bottom foot 72 has a top surface 80 that the leading edge 26 of the daughter board 18 can seat against when the board 18 is fully inserted. The top surface 80 also functions to eject the board 18 when the ejectors are pivoted to an eject position. The snap-lock pivot sections 74 of the ejectors 22 are pivotably mounted in the snap-lock pivot sections 56 of the guide projections 44. Snap-lock mounting of the ejectors 22 to the housing 34 makes the addition of the ejectors 22 to the housing 34 easy and simple. The ejector pivot section 74 is able to pivot in the housing pivot section 56. Sections 82 of the ejectors 22 act as a stop to limit the pivotable movement of the ejectors. Seating ledges 76 cooperate with ledges 58 in the slots 54 to insure that the ejectors are in their fully downwardly seated position when they are in their non-ejecting home positions. The non-ejecting home position generally comprises the ejectors being substantially contained inside the guide portions 44, except for the finger contact sections 78, and the ejector feet 72 being positioned so as not to interfere with the full insertion of the card edge 26 into the receiving area 46. The cooperation between the ledges 58 and 76 insures that the ejector feet 70 will be located in the receiving slot 46 and, therefore, not interfere with full insertion of the card edge 26. The contact between the ledges 58, 76 also act as a frictional detent to keep the ejectors in their non-ejecting home positions. The finger contact sections 78 are adapted to be located over the top of the guide projections 44 in the ejector non-ejecting home positions. They include a leading tip 84 that, when the ejectors are in their non-ejecting position, project past the interior edge of the top of the guide projections 44. As seen in FIG. 2, the daughter board 18 has ledges 86 at its ends. The leading tips 84 are adapted to project over the ledges 86 to prevent the daughter board 18 from unintentional removal of the board 18 from the receiving area 46.

Insertion of the daughter board 18 merely comprises inserting the end edges 52 of the daughter board 18 into the interior facing slots 50. Continued insertion results in the card edge 26 being inserted in the receiving area 46 such that the contact pads 24 make contact with the spring contact sections 62 of the contacts 36. The leading tips 84 of the ejector finger contact sections 78 close over the ledges 86 to keep the board 18 locked in the connector. When it is desired to remove the board 18, a user merely presses the ejector finger contact sections 78 outward. The ejectors 22 pivot at pivot sections 56, 74. The leading tips 84 move out of the path of the ledges 86 and the ejector feet 72 simultaneously push up on the card edge 26. The card edge 26 is thus moved out of the receiving area 46. The user can then merely pull the board 18 out of the slots 50.

As seen best in FIG. 1, one of the advantages of the connector 12 described above is the fact that it allows for the electronic component to be more compact. In the embodiment shown, the two mother boards 14, 16 are spaced a center-to-center distance A of about 0.8 inch. The solder tails 64 are spaced from adjacent rows at a center-to-center spacing B of about 0.075 inch. The total distance C under the solder tails for each connector is only about 0.225 inch. The height D of the connectors is only about 0.7 inch. The width E of each connector is only about 0.3 inch. The distance F between similar locations of the two connectors 12 is only about 0.85 inch. The lift out of the board 18 by the ejectors 22 is about 0.15 inch. However, in alternate embodiments, other dimensions could be provided.

In order to make the connector compact, the two piece housing 34 was used in order to make assembly much easier. After the contacts 36 are fixedly inserted into the first member 38, the second member (keeper) 40 is fixedly attached to the first member 38 with the solder tails 64 extending through the holes 68. The open area 70 formed by this two piece housing accommodates the different shapes of the contact middle sections 66 and, reduces the overall weight of the connector. The connectors 12 are also adapted to be placed directly adjacent each other to further conserve space used on the mother board 14. Because the guide projections 44 are integrally formed with the middle section 42, the connector can be used with or without the ejectors 22. The flat nature of the keeper 40 allows for a good secure mounting on the mother board 14 and, the connection of the first member 38 to the keeper 40 nonetheless provides the angled receiving area 46 for the compact configuration shown. This is done without excessive material having to be used for the housing parts.

Referring now to FIGS. 4A–4C, an alternate embodiment of the present invention is shown. The connector 90 generally comprises a housing 92 and electrical contacts 94. The housing 92 is made of dielectric material, such as molded polymer or plastic material. The housing 92 has an elongate center section 96 and two end sections 98. The center section 96 has a card edge receiving slot 100 and contact channels 102. The end sections 98 are basically mirror images of each other and each includes a raised post section 104. Each post section 104 has a tapered base 106, an end portion 108 extending up from the tapered base 106, and two opposing side guides 110 also extending up from the tapered base 106. The end portion 108 and side guides 110 all extend up from the tapered base 106 in general cantilever fashion. The interior sides of the side guides 110 have interference stabilizer projections 112. Area 114 between the two side guides 110 is adapted to receive a portion of a daughter printed circuit board therein. The projections 112 are adapted to make an interference gripping with a daughter board inserted into area 114. The end sections 98 are thus able to function as guides for allowing proper insertion of the daughter board into the card edge receiving slot 100. Because the depth of the slot 100 is so small, the end sections 98 also function as stabilizers for the daughter board on the housing. In addition, the interference between the projections 112 and the daughter board functions to frictionally retain the daughter board to the connector 90.

The contacts 94 are made of electrically conductive material and are mounted to the housing 92 in the contact channels 102. The contacts 94 have tail ends 116 that extend out of the bottom of the housing 92. The tail ends 116 function as through-hole solder tails. The rest of the contacts are located in the housing with contact areas 118 extending into the card edge receiving slot 100. The widest portion of the contact 94 i located at its top 120 where it is bent. The width of each contact 94 progressively decreases on both sides of the contact away from the top bend 120. This shape is provided for uniform stress distribution on the contact. However, any suitable contacts could be provided. Referring also to FIG. 5, a plurality of the connectors 90 are shown connected to a first mother board 14 and sandwiched under a second mother board 16. As seen, the connectors 90 are compactly connected next to each other; side-by-side. The gap 122 between exterior sides of the connectors 90 may even be zero. However, because of the unique shapes of the post sections 104 relatively wide open areas 124 are formed between the post sections 104 of adjacent connectors 90 at end sections 98. These relatively wide open areas 124 allow air to circulate. Thus, daughter boards mounted in the connectors 90 can have better cooling air flow in the otherwise confined and congested area between the two boards 14, 16. The shape of the post sections 104 not only function as guides, stabilizers and retainers for the daughter boards, but they also allow good cooling air flow to the daughter boards mounted to the series of connectors.

Figure 6:
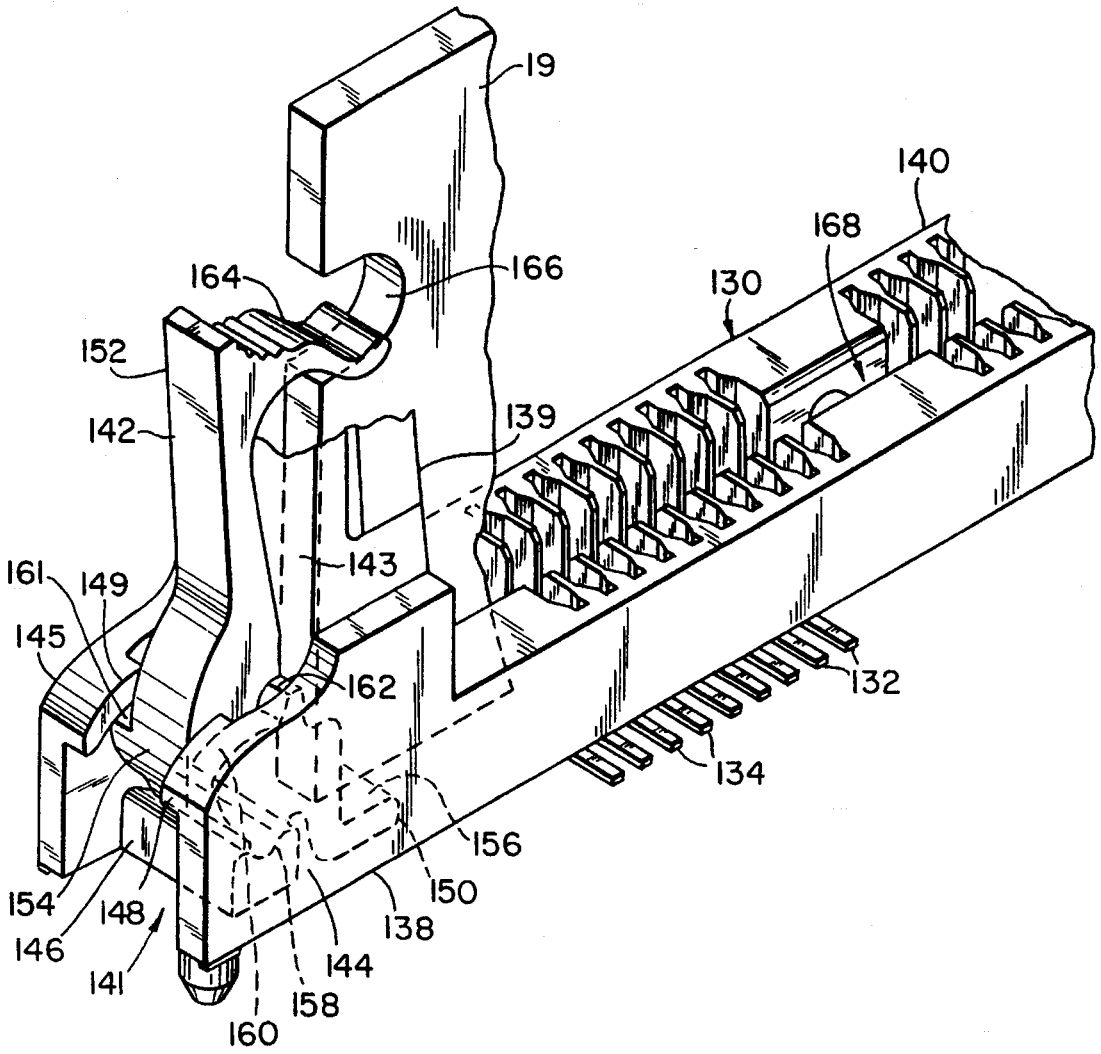
FIG. 6 is a perspective view of one end of an alternate embodiment of the present invention.

Referring now to FIG. 6, a perspective view of an end of an alternate embodiment of the present invention is shown. The connector 130 is shown with a partial view of a daughter board 19 connected thereto. The connector 130 is similar to the connector shown in FIGS. 4A–4C, but with several differences. The tail ends 132 of the contacts 134 are surface mount solder tails. The end section 138 of the housing 140 has a raised post section 139 (shown partially cut-away). The end section 138 also has a receiving area 141 for operably mounting an ejector 142. The receiving area 141 is generally established by two side sections 144, 145, a bottom rail 146 between the two side sections 144, 145, and two retaining projections 148, 149 extending from the two side sections 144, 145 towards each other at the top of the receiving area 141. The raised post section 139 is substantially similar to the raised post sections 104 of the embodiment shown in FIGS. 4A–4C. However, the end portion 143 of the raised post section 139 stops below cantilevered extension 164. The ejector 142 generally comprises an ejector foot 150, a finger contact section 152, and a mounting section 154. The foot 150 includes a top surface 156 that the bottom surface of the daughter board 19 rests against. The mounting section 154 has a bottom pivot surface 158, two top side ledges 160, 161, and a stop 162 at a front end of each of the side ledges 160, 161. The finger contact section 152 has a cantilevered extension 164.

The ejector 142 is snap-lock mounted into the receiving area 141 with bottom pivot surface 158 resting on the bottom rail 146. The two top side ledges 160, 161 are located under the projections 148, 149. In this fashion, the mounting section 154 is retained between the projections 148, 149 and the bottom rail 146. The ejector 142 can pivot at the mounting section 154 relative to the housing 140 in order to move the ejector foot 150. The stops 162 (only one of which is shown) limit the pivotal movement of the ejector when they come into contact with the fronts of the projections 148, 149. The cantilevered extension 164 is adapted to project into notch 166 in the daughter board 19. The ejector 142 is made of a suitable resilient deflectable material, such as a plastic or polymer material. The extension 164 is suitably shaped and has a suitable distance above the bottom of the card receiving slot 168 such that, when the card 19 is inserted in the slot 168 and the ejector is closed, the extension 164 projects into the notch 166 and is deflected slightly upward by the card 19 at the notch. The extension 164 is thus adapted to bias the card 19 downward against the bottom of the slot 168. In this fashion, the card 19 is prevented from moving in the slot 168. This prevents fretting corrosion from occurring between contacts on the card 19 and contacts of the connector 130 in the slot 168. The curvature of the leading edge of the extension 164 prevents the card 19 from being damaged when the ejector 142 is closed. Because the housing 140 has raised post sections 139, the connector can be used with or without the ejectors 142. In this fashion, the assembler of an electronic device can configure the connector to suit the needs of the electronic device. This can obviously reduce the cost of the electronic device.

Figure 7A:
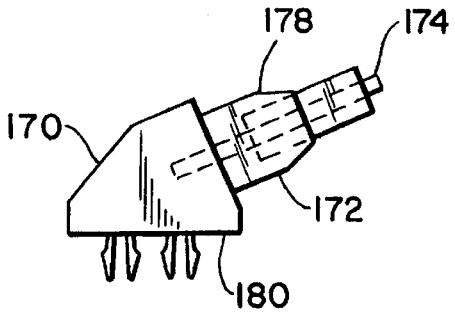
FIG. 7A is an elevational end view of an alternate embodiment of the present invention.
Figure 7B:
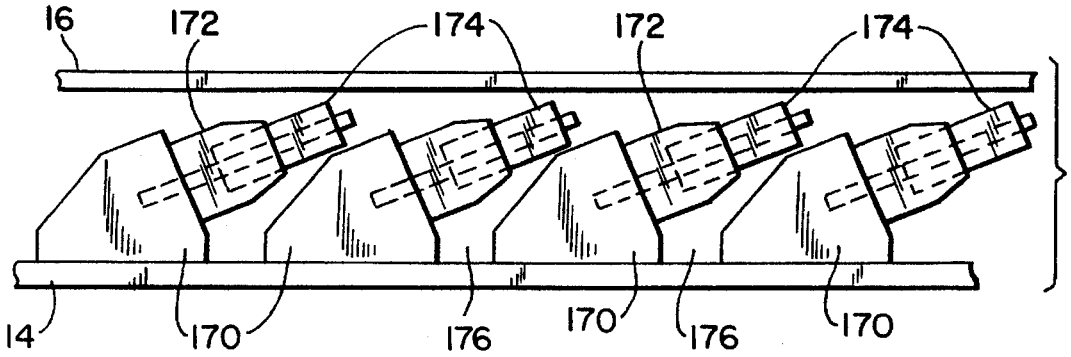
FIG. 7B is a partial schematic elevation end view of a plurality of the connector shown in FIG. 7A mounted in an electronic component.

Referring now to FIG. 7A, there is shown an elevational end view of an alternate embodiment of the present invention with a DIMM (Dual In-Line Memory Module) 174 connected to it. The connector 170 has end sections 172 with raised post sections 178 substantially similar to the end sections 98 of the embodiment shown in FIGS. 4A–4C and 5. However, the connector 170 is an angled connector, similar to the connectors shown in FIG. 1, with the raised post sections 178 angled relative to the bottom surface 180 of the housing but without ejectors. Referring also to FIG. 7B, a plurality of connectors 170 are shown connected to a first board 14 under a second board 16. The shape of the end sections 172 provide a greater air flow path by providing relatively open areas 176 between the connectors 170, but still allows the distance between the two boards 14, 16 to be very small. The distance or pitch between the connectors 170 is also kept small.

It should be understood that the foregoing description is only illustrative of the invention. Various alternatives and modifications can be devised by those skilled in the art without departing from the spirit of the invention. Accordingly, the present invention is intended to embrace all such alternative, modifications and variances which fall within the scope of the appended claims.

What is claimed is:

1. A card edge connector comprising:

a housing having a first member and a second member, the first member comprising a middle section with a card edge receiving area and two rows of contact receiving channels, one of the rows on each side of the receiving area, and two guiding projections located at opposite ends of the middle section, the second member comprising a keeper section with at least four rows of contact passages, the housing being suitably sized and shaped to be connected to a mother printed circuit board and have a daughter printed circuit board connected to the housing in the card edge receiving area at an angle of between about 20° and about 60° relative to a plane of the keeper section; and electrical contacts located in the contact receiving channels and extending through the contact passages of the keeper section.

2. A connector as in claim 1 herein the angle is about 30°.

3. A connector as in claim 1 further comprising ejectors movably mounted to the housing at the guiding projections.

4. A connector as in claim 3 wherein the ejectors include locking sections that engage a fully inserted daughter board and lock the daughter board to the connector.

5. A connector as in claim 3 wherein the connector has a height, measured perpendicularly from a mother board connected to the connector of about 0.68 inch.

6. A connector as in claim 3 wherein the guide projections each have an interior facing slot for slidingly receiving an end edge of a daughter board and an exterior facing slot with the ejectors pivotably mounted therein, the ejectors being movable between an eject position and a home position.

7. A connector as in claim 6 wherein the ejectors are snap-lock mounted to the guide projections.

8. A card edge connector comprising:

a housing having a middle section and two substantially stationary guiding projections located at opposite ends of the middle section, the middle section having a card edge receiving area and two rows of contact receiving channels on opposite sides of the receiving area, the two substantially stationary guiding projections each having an interior facing slot for slidingly receiving an end edge of a daughter board, each of the guiding projections making constant contact with opposite sides of an inserted daughter board, the housing being suitably sized and shaped to be connected to a mother printed circuit board and have the daughter printed circuit board connected to the housing in the card edge receiving area at an angle of between about 20° and 60° relative to a plane of the mother printed circuit board;

electrical contacts located in the contact receiving channels and extending from a bottom of the housing; and ejectors pivotably connected to the housing at the guide projections adapted to eject, at least partially, a daughter printed circuit board from the card edge receiving area.

9. A connector as in claim 8 wherein the angle is about 30° and the height of the connector is about 0.68 inch.

10. A connector as in claim 8 wherein the housing is comprised of a first member having the middle section and a second member having a keeper section.

11. A connector as in claim 10 wherein the keeper section has at least four rows of contact passages with the electrical contacts passing through the passages from the middle section to a bottom of the housing.

12. A connector as in claim 8 wherein the ejectors include locking sections that engage a fully inserted daughter board and lock the daughter board to the connector.

13. A connector as in claim 12 wherein the locking sections are also finger contact areas for a user to move the ejectors.

14. A card edge electrical connector comprising:

electrical contacts; and a single-piece housing having the contact mounted thereon, the housing comprising an elongate center section and two end sections, the center section having a card edge receiving slot, the end sections each having a raised post section with an upwardly tapered base section and two opposing cantilever side guides extending upward from a top of the tapered base section, the side guides and base sections forming areas on opposite ends of the center section for receiving side edges of a printed circuit board therein, and being located in front of a top surface of the center section.

15. A connector as in claim 14 wherein each of the two cantilever side guides of each raised post section has an inwardly facing projection adapted to make contact with the printed circuit board.

16. A connector as in claim 14 wherein each of the raised post sections include a cantilevered end portion extending upward from the top of the tapered base section.

17. A connector as in claim 14 wherein the raised post sections are suitably shaped such that, when two of the connectors are placed side-by-side, relatively wide open areas are formed between their proximally located raised post sections.

18. A connector as in claim 14 wherein the raised post sections are angled relative to a bottom surface of the housing.

19. A card edge electrical connector comprising:

a housing having a card edge receiving slot;

electrical contacts mounted to the housing; and an ejector pivotably mounted to an end of the housing, the ejector having an ejector foot and a resiliently deflectable cantilevered extension, the extension being adapted to engage a side portion of a printed circuit board, when the board is properly positioned in the card edge receiving slot and the ejector is in a locking position, and bias a bottom of the board into a bottom of the slot.

20. A connector as in claim 19 wherein the ejector is snap-lock mounted to the housing.

21. A connector as in claim 20 wherein the end of the housing has an ejector receiving area formed by a bottom rail, two side sections, and a projection at the top of each side section extending towards each other.

22. A connector as in claim 21 wherein the end includes a raised post section with an area for receiving a side edge of the printed circuit board.

23. A card edge connector comprising:

electrical contacts; and a one-piece housing having the contacts mounted thereon, the housing comprising an elongate center section and two end sections, the center section having a card edge receiving slot, each of the end sections having two opposing upwardly extending cantilever beam side guides, the side guides being deflectable, forming areas on opposite ends of the center section for receiving end edges of a printed circuit board therein, and extending beyond a top surface of the center section.

24. A connector as in claim 23 wherein each end section has an upwardly extending end portion that forms an end to an area between the two opposing side guides for each end section.

25. A connector as in claim 23 wherein each side guide has an inwardly facing projection adapted to make contact with an inserted printed circuit board.

* * * * *